US005938483A

United States Patent [19]

Zweigle et al.

[11] Patent Number: 5,938,483

[45] Date of Patent: Aug. 17, 1999

[54] FOUR-POLE ELECTRIC CONNECTOR

[75] Inventors: Peter Zweigle, Ditzingen; Uwe Steinhauser, Filderstadt, both of Germany

[73] Assignee: Robert Bosch GmbH, Stuttgart, Germany

[21] Appl. No.: 08/972,759

[22] Filed: Nov. 18, 1997

[30] Foreign Application Priority Data

Dec. 21, 1996 [DE] Germany ..... 296 22 273 U

[51] Int. Cl.[6] ..... H01R 13/514

[52] U.S. Cl. ..... 439/752

[58] Field of Search ..... 439/752, 157

[56] References Cited

U.S. PATENT DOCUMENTS

| | | | |
|---|---|---|---|
| 5,389,014 | 2/1995 | Kumpel et al. | 439/752 |
| 5,478,251 | 12/1995 | Jaklin | 439/157 |
| 5,775,957 | 7/1998 | Fink et al. | 439/752 |
| 5,823,807 | 10/1998 | Yamasaki et al. | 439/157 |

FOREIGN PATENT DOCUMENTS 40 39 239 10/1991 Germany .

*Primary Examiner*—Neil Abrams
*Assistant Examiner*—Barry M. L. Standig
*Attorney, Agent, or Firm*—Kenyon & Kenyon

[57] ABSTRACT

A four-pole electric connector is designed so that the contact elements can be easily locked to their axial fastening. The connector has a slide for coupling with a mating connector, which slide can be inserted in receptacles of a contact carrier of the connector transversally to the direction of insertion of contact elements and moved longitudinally. The slide contains a seat for a locking element, which is provided for axially securing the contact elements. The locking element is brought together and joined with the contact elements through an insertion motion of the slide until a closing position is reached, where the locking element engages with the contact carrier. When the slide is moved in the opposite direction to an open position, the locking element is removed from the seat in a similar manner, while it remains on the contact carrier and the contact elements.

4 Claims, 1 Drawing Sheet

FOUR-POLE ELECTRIC CONNECTOR

BACKGROUND INFORMATION

A four-pole electric connector is described in German Patent Application No. 40 39 239 A1, in which a contact element is used in each receptacle along a longitudinal axis in a contact carrier of a connector containing a plurality of receptacles arranged in rows.

A comb-like locking element is provided for axially securing the contact elements in the receptacles. The locking element contains a comb-tooth-like rigid web for each row of receptacles.

Each contact element can be overlapped by an end region of a web in the area of a locking section whose cross section is reduced in relation to adjacent sections.

When the connector is mounted, the locking element should be pushed, in a separate operation, through a shaft, whose end face is in contact with the contact carrier, before the contact carrier is inserted into an enclosure of the connector and, thus, the front end of the shaft is covered to secure the locking element.

Handling the locking element in this manner is inconvenient from the manufacturing point of view, since not only does it have to be received by a container, conveyed, aligned, and assembled in a separate operation, but there is also the danger that the locking element may become damaged due to the fact that it is conveyed without protection and the contact element is not secured in position after assembly, which ultimately may result in failure of the connector.

SUMMARY OF THE INVENTION

The four-pole electric connector according to the present invention has the advantage over the related art in that the above-mentioned inconveniences are avoided. A slider, which can be moved longitudinally across the contact elements, is placed on the connector in order to facilitate the application of joining and separating forces between the connector and a mating connector. The slider has a handle piece to facilitate handling. There is a recess for removably inserting the locking element in the handle piece.

This arrangement has the advantage that the manufacturer of the connector, who manufactures the contact carrier, the locking element, and the slider by a plastic injection molding process, can insert the locking element into the slide, so that it is protected until it is delivered to a manufacturer's assembly site where the contact elements are inserted into the contact carrier and cannot be left out when the connector is assembled.

When the slide is inserted after the contact elements are mounted on the contact carrier, the locking element is connected to the contact elements without hand contact and, when the slide is moved out into an open position where the connector can be joined with the mating connector, it is disconnected from the slide.

Such handling of the locking element is advantageous from the manufacturing point of view, since it prevents the locking element from being damaged, can be performed in a simple manner, and results in a reliably operating connector.

DETAILED DESCRIPTION

Figure 1:
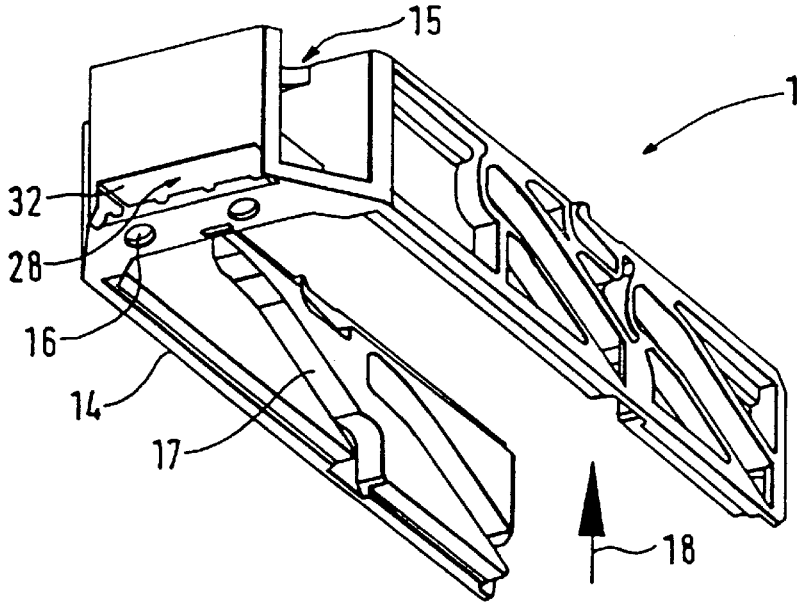
FIG. 1 shows a perspective view of a connector slide according to the present invention.
Figure 2:
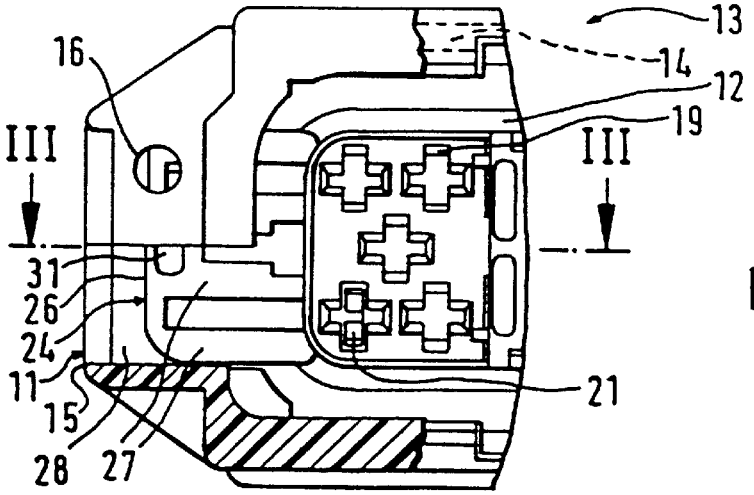
FIG. 2 shows a cross section of part of the connector according to the present invention.

FIG. 1 shows a slide 11 as the handling part of an electric connector, which, according to FIG. 2, can be inserted into a contact carrier 12 of a connector 13 and moved there for detachable coupling of connector 13 with a mating connector (not illustrated) forming the electrical plug-and-socket connection.

Slide 11 has two flat legs 14 opposite and parallel to one another with one end connected to a handle piece 15 designed for manual actuation, but also having catching elements, for example, bore holes, for mechanical actuation.

Legs 14 have slide grooves in a known manner, serving as guide means 17, which, in an open position of slide 11, where this is pushed into contact carrier 12 over part of its length and where connector 13 and the mating connector are joined, work together with the guide elements insertable into guide means 17 of the mating connector so that a longitudinal displacement of slide 11 into contact carrier 12 up to a closing position results in a shift of the respective mating connector in a connecting direction corresponding to the direction of arrow 18. A connector that can be closed in this manner can be reopened by moving slide 11 in the opposite direction to the open position.

Figure 3:
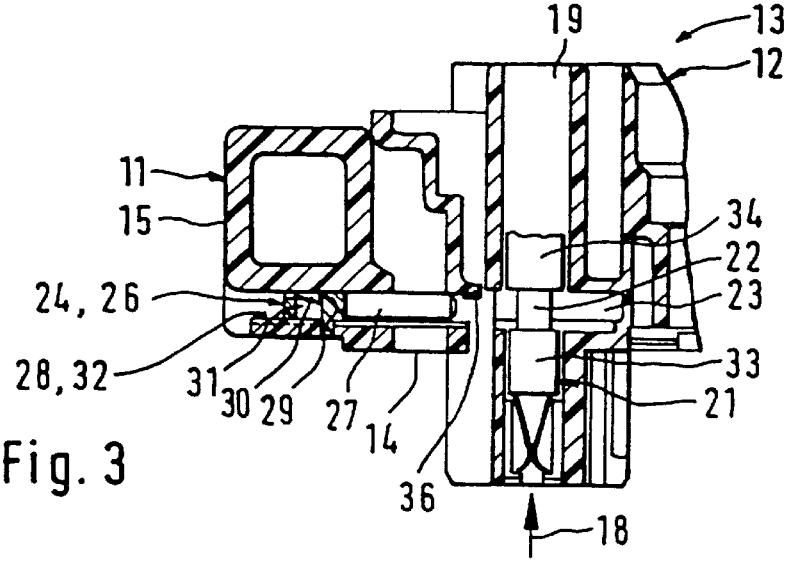
FIG. 3 shows a side view of the connector sectioned along line III—III of FIG. 2.

Contact carrier 12, illustrated in FIGS. 2 and 3, comprises a plurality of receptacles 19 arranged in rows, into each of which a schematically represented contact element 21 can be inserted in the direction opposite to the connecting direction.

Contact element 21 contains, in a known manner, a locking section 22, which has a reduced cross section compared to the adjacent sections of contact element 21.

When contact elements 21 are fully inserted in receptacles 19, a locking element 24 can be inserted in contact carrier 12 through shaft 23 illustrated in FIG. 3. Shaft 23 is transverse to the direction of assembly of contact elements 21 and intersects receptacles 19 in the area of the locking sections 22 of contact elements 21.

Locking element 24 has a comb-like flat design and contains for each row of receptacles 19 two rigid webs 27 projecting in right angles from a back 26. A seat 28 in the form of a rectangular passage is formed in handle piece 15 of slide 11 for the detachable placement of locking element 24 in slide 11; the internal diameter of the passage is larger than locking element 24 by a fitting tolerance; a catch shoulder 29 projects into seat 28 and ends in a ramp 30 at the free end of handle piece 15. Catch shoulder 29 engages in a catch opening 31 of locking element 24 in a predefined position of locking element 24 in seat 28.

To mount locking element 24 in slide 11, after slide 11 has been manufactured by a plastic injection process as a complementary part with webs 27, locking element 24 is pushed into seat 28 with webs 27 facing forward through an insertion orifice 32 until catch shoulder 29 engages in catch opening 31.

At an assembly site, contact slide 11 thus assembled is introduced in contact carrier 12, where the contact carrier 12 is provided with contact elements 21, until the closing position; each web 27 comes into a locking position with axial overlap on both sides of locking section 22 with box-like central sections 33 and connection section 34 of contact elements 21 arranged in the corresponding row in contact carrier 12. In addition, in this locking position, webs 27 partially overlap with receptacles 19.

When the closing position of slide 11 is reached, a catch connection is established between a catch arm 36 of contact carrier 12 and catch opening 31 of locking element 24, through which this position of locking element 24, where contact elements 21 are axially fixed, is secured.

When the open position of slide 11 is reached, the mating connector can be joined with connector 13 and then, by again moving slide 11 into the closing position, the plug-and-socket connection can be established with the axial plugging forces or, when opening, with the axial disconnecting forces that act upon contact elements 21 being applied to locking element 24.

When slide 11 is moved back from the closing position to the open position, locking element 24 remains on contact carrier 12 and is detached from slide 11, since catch shoulder 29 can now be guided out of catch opening 31 through wedge-shaped ramp 30.

Handling the locking element 24 in the manner described above by temporarily placing slide 11 into seat 28 in handle piece 15 of slide 11 ensures that locking element 24 is delivered correctly mounted to the assembly site and can be secured by simply moving slide 11 into the closing position on contact carrier 12 provided with contact elements 21 without possibility of error.

What is claimed is:

1. A four-pole electric connector comprising:

a contact carrier composed at least partially of an insulating material, the contact carrier including at least one row of receptacles and a corresponding number of contact elements, each of the contact elements being inserted into a corresponding one of the receptacles, each of the contact elements having a locking section having a reduced cross-section compared to adjacent sections of the contact element, the contact carrier further including at least one shaft;

a locking element inserted into the at least one shaft, the locking element intersecting the receptacles transverse to a direction of insertion of the contact elements into the receptacles until a locking position is reached, the locking element containing webs that are parallel in the locking position and partially overlap with the receptacles and the contact elements; and a slide inserted transverse to the direction of insertion of the contact elements into the receptacles for a detachable connection with a mating connector for a longitudinal movement, the slide including a seat, the locking element being mounted in the seat and being engaged in the locking position on the contact carrier when the slide is inserted, the locking element being guided out of the seat after the engagement with an opposite direction movement of the slide while the locking element remains on the contact carrier.

2. The connector according to claim 1, wherein the slide is U-shaped and has two parallel legs, the legs being bridged on one end by a handle piece, the seat being arranged in the handle piece.

3. The connector according to claim 2, wherein the seat is shaped as a flat passage, the locking element being inserted in the seat through an insertion opening, the webs facing forward and being directed towards the contact carrier, the locking element detachably engaging, through a catch opening, with a catch shoulder projecting into the seat.

4. The connector according to claim 3, wherein a catch arm is formed on the contact carrier, the catch arm engaging with the catch opening when the slide is inserted into the contact carrier for securing the locking element on the contact carrier.

* * * * *